US007185387B1

(12) United States Patent
Lin

(10) Patent No.: US 7,185,387 B1
(45) Date of Patent: Mar. 6, 2007

(54) DISMOUNTABLE CLEANING HEAD FOR SWEEPING APPARATUS

(76) Inventor: Ming-Hsien Lin, No. 13, Hun Yi St., Pu Tzi Chen Ind Dist, Chia Yi Hsien (TW)

( * ) Notice: Subject to any disclaimer, the term of this patent is extended or adjusted under 35 U.S.C. 154(b) by 0 days.

(21) Appl. No.: 11/361,099

(22) Filed: Feb. 23, 2006

(51) Int. Cl.
*A47I 13/014* (2006.01)
*A47I 13/144* (2006.01)

(52) U.S. Cl. ..... 15/119.1; 15/119.2

(58) Field of Classification Search ..... None
See application file for complete search history.

(56) References Cited

U.S. PATENT DOCUMENTS 6,915,542 B1 * 7/2005 Lin ..... 15/119.2
6,983,509 B2 * 1/2006 Lin ..... 15/119.2

* cited by examiner

*Primary Examiner*—David Redding
(74) *Attorney, Agent, or Firm*—Pro-Techtor Int'l Services

(57) ABSTRACT

A cleaning head for a sweeping and wringing apparatus, connected with a connecting part thereof, comprises a cleaning element, having a sweeping part and a held part, a base plate on an upper side of the cleaning part, on a top side carrying two fastening elements which each have a hole, and a fastening device for mounting the fastening elements on a lower end of a connecting part, with the fastening device further comprising two end pieces, each having a cross-shaped cross-section and an outer projection with a circular cross-section, leaning against one of the fixing elements, passing through the hole thereof, and an inner projection, and a spring, placed between the two end pieces and having ends that are put over the inner projections of the two end pieces, so that the cleaning head is easily installed and replaced.

7 Claims, 8 Drawing Sheets

DISMOUNTABLE CLEANING HEAD FOR SWEEPING APPARATUS

BACKGROUND OF THE INVENTION

1. Field of the Invention

The present invention relates to a cleaning head for a sweeping and wringing apparatus, particularly to a cleaning head for a sweeping and wringing apparatus which is fastened in a way to facilitate mounting and replacing thereof.

2. Description of Related Art

As shown in FIGS. 8–10, a conventional sweeping and wringing apparatus comprises: a cleaning head 1, a squeezing head 2, a main rod 3, a U-shaped wringing rod 4, two connecting rods 5, two transverse bars 56, and two squeezers 57. The cleaning head 1 has a base plate 11 and a cleaning element 12 and is used for sweeping a floor. The squeezing head 2 is placed on an upper side of the cleaning head 1, partly surrounding the cleaning head 1 in the shape of the inverted letter U, and has an upper part, having a fastening hole 21 and two sides with openings 22, and downward extending front and rear parts, each of which have a left arm 23 and a right arm 24 further extending downward, enclosing an opening 27. Through holes 25, 26 are bored through the left and right arms 23, 24, respectively. The main rod 3 is mounted on the fastening hole 21 of the squeezing head 2 and serves as a hold during sweeping. The wringing rod 4 is on two ends thereof hingedly connected with the main rod 3 at a middle section thereof and has an outward-reaching middle section with a grip 41, facilitating pulling up of the wringing rod 4. The two connecting rods 5 are symmetrically disposed along two lateral sides of the main rod 3, having upper ends that are hingedly connected with the wringing rod 4 and lower ends that respectively pass through the openings 22 and are fastened to the base plate 11 of the cleaning head 1. The two connecting rods 5 are moved upward by pulling up of the wringing rod 4, in turn pulling the cleaning head 1 upward. The two transverse bars 56 are respectively mounted on the front and rear parts of the squeezing head 2, each passing through the through holes 25, 26 of the left and right arms 23, 24. The two squeezers 57 are respectively set on the two transverse bars 56, leaving a gap in between. When the cleaning element 12 enters the gap between the two squeezers 57, water contained therein is squeezed out.

For wringing the cleaning head 1, the user holds the main rod 3 with one hand and, with the other hand holding the grip 41, pushes up the wringing rod 4, so that the two connecting rods 5 pull up the base plate 11, taking along the cleaning element 12. The cleaning element 12, having entered the gap between the two squeezers 57, is compressed, and water contained therein is squeezed out. After the cleaning element 12 has been wrung, the two connecting rods are pushed down to an original position, in turn pushing down the cleaning element 12 to an original position. Repeated pushing up and down of the wringing rod 4 brings about complete wringing of the cleaning element 12.

As shown in FIGS. 8–10, the conventional cleaning element 12 has an elongated shape with a sweeping part 121 and a held part 122 and is made of water-absorbing material. The base plate 11 has a U-shaped cross-section with jagged edges 111 which hold the held part 122 of the cleaning element 12. Several holes 112 are bored into a base of the base plate 11, allowing to fasten the base plate 11 to the two connecting rods 5. The design just described is convenient and widely used, but still has the following shortcomings.

1. Assembly is not convenient, as the cleaning head 1 must be mounted on the two connecting rods 5, which takes much time.

2. Replacing is not convenient. If, after some time of usage, the cleaning head 1 needs to be replaced, special tools are required, which is not convenient. Furthermore, the connection between the connecting rods 5 and the cleaning head 1 is often corroded, so replacing of the cleaning head 1 is difficult. Then the whole sweeping and wringing apparatus is usually thrown away, which is a waste.

SUMMARY OF THE INVENTION

It is an object of the present invention to provide a cleaning head for a sweeping and wringing apparatus which has a simple structure.

Another object of the present invention is to provide a cleaning head for a sweeping and wringing apparatus which is easy to replace.

The present invention can be more fully understood by reference to the following description and accompanying drawings.

DETAILED DESCRIPTION OF THE PREFERRED EMBODIMENTS

Referring to FIGS. 1–4, the present invention is based on a sweeping and wringing apparatus as shown in FIGS. 8–10. The present invention is characterized by having a cleaning head 1*a*, a main rod 3*a* with an elongated opening 31 in a lower section, a wringing mechanism having a U-shaped wringing rod 4*a*, to which at an upper section a connecting rod 5*a* is attached, and a connecting part 6. The cleaning head 1*a* is fastened to a lower end of the connecting part 6.

The cleaning head 1*a* has a cleaning element 12*a* which is squeezed like the cleaning element 12 of conventional art. In contrast to conventional art, the cleaning head 1*a* has a base plate 11*a* which is mounted by an compressible fixing device 7, whereby manufacturing is inexpensive and replacing is conveninent.

Referring to FIGS. 1–4, in a first embodiment of the present invention, the cleaning element 12*a* of the cleaning head 1*a* has a sweeping part 14 and a held part 16 attached to a top side thereof. The base plate 11*a* is an elongated piece of metal channel having a cross-section shaped like the inverted letter U with jagged lower edges for holding the held part 16 of the cleaning element 12*a*. Two fixing elements 15 are set on an upper side, each having a hole 17, so as to allow to fasten the fixing elements 15 to holes 61 at the lower end of the connecting part 6. The fixing device 7 comprises two end pieces 71, each having a central retainer portion, an outer projection 73 and an inner projection 75. For each of the end pieces 71, the outer projection 73 has a circular cross-section and passes through the hole 17 of one of the fixing elements 15. A spring 72 is placed between the two end pieces 71, having ends that are put over the inner projections 75 of the two end pieces 71 and pressing the two end pieces 71 against the fixing elements 15. For mounting the cleaning head 1*a*, the fixing device 7 is compressed, and the outer projections 73 are inserted into the holes 61 of the connecting part 6. For dismounting the cleaning head 1*a*, the fixing device 7 is compressed again, and the outer projections 73 are taken out from the holes 61 of the connecting part 6.

Since the connecting part 6 and the connecting rod 5*a*, which serve to connect to the base plate 11*a*, are placed inside the main rod 3*a*, a simple structure results, and the cleaning head 1*a* is easily replaced.

Referring to FIG. 5, in a second embodiment of the present invention, a base plate 11*b* has a cross-section shaped like the inverted letter U, with transverse holes allowing to fasten the held part 16 of the cleaning head 12*a* thereto by bolts 113.

Referring to FIG. 6, in a third embodiment of the present invention, the fixing elements 15 are attached to a connecting plate 18 which is fastened to the base plate 11*a* by screws 19 or forms an intergrated body with the base plate 11*a*.

Referring to FIG. 7, in a fourth embodiment of the present invention, fixing elements 15*b* are placed outside of the lower end of the connecting part 6.

Figure 1:
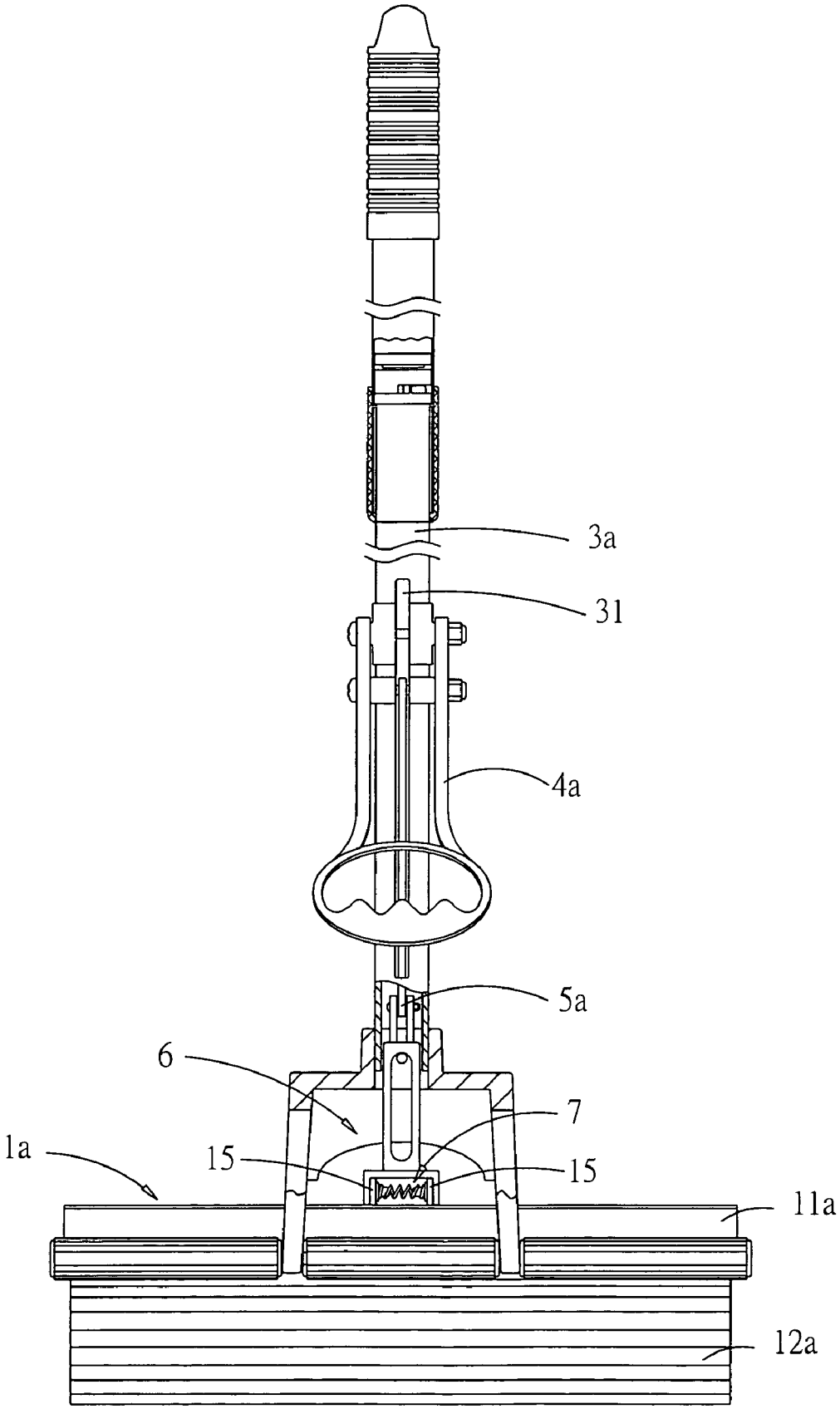
FIG. 1 is a front view of the present invention.
Figure 2:
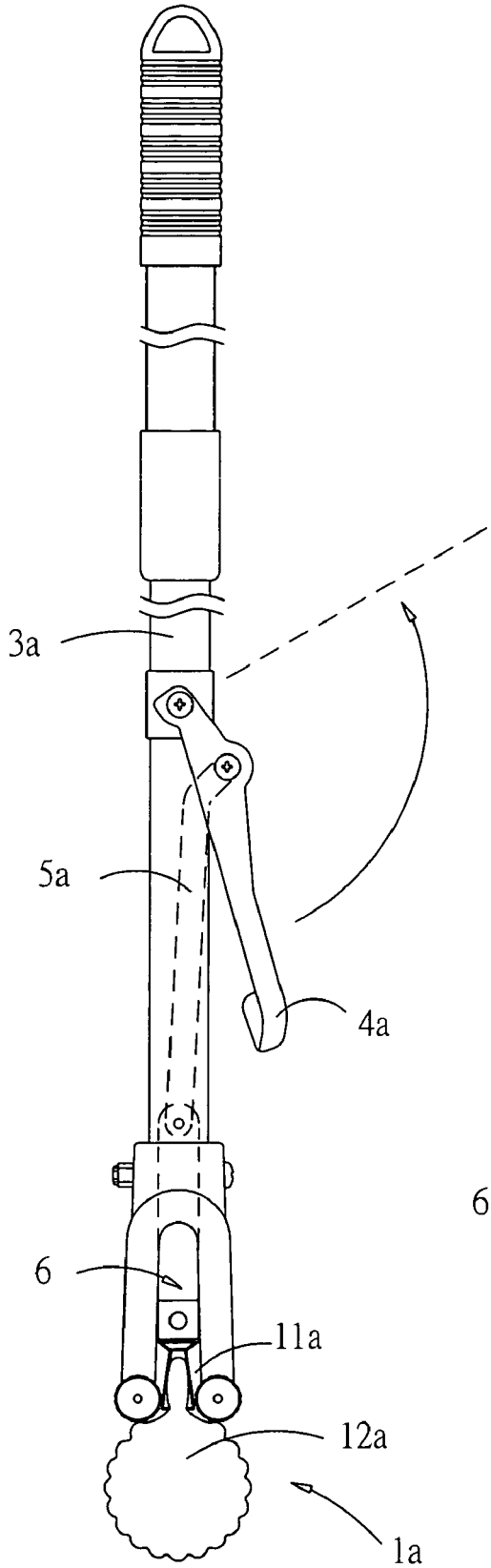
FIG. 2 is a side view of the present invention.
Figure 3:
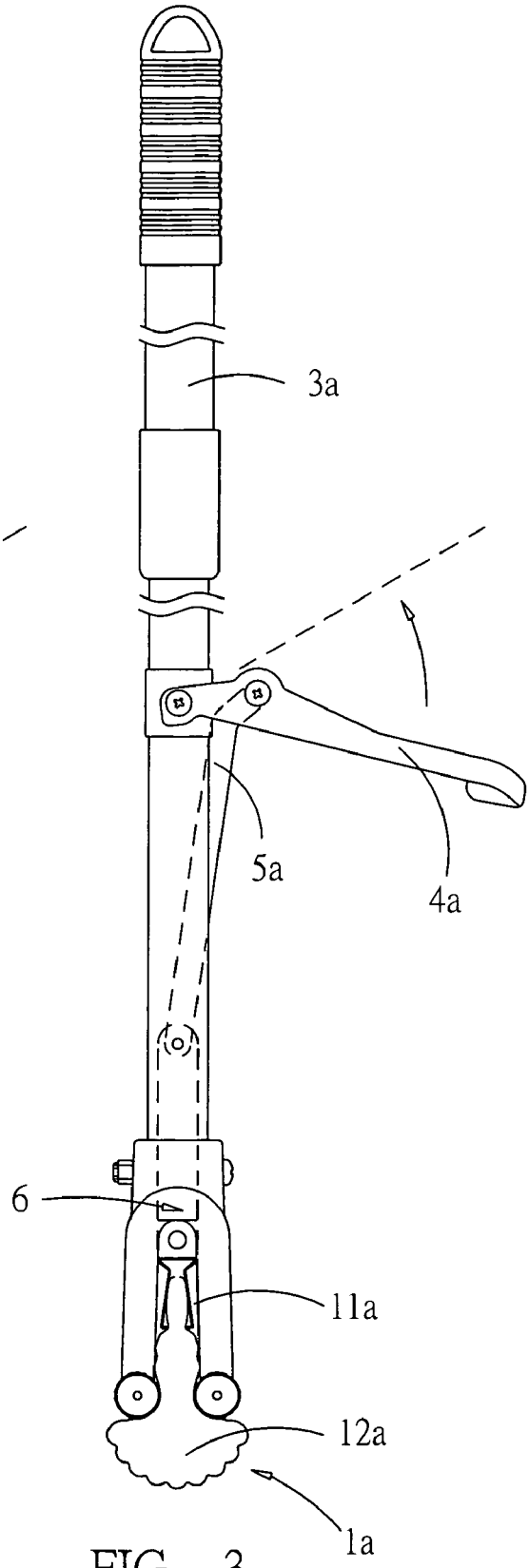
FIG. 3 is a side view of the present invention during wringing of the cleaning element.
Figure 4:
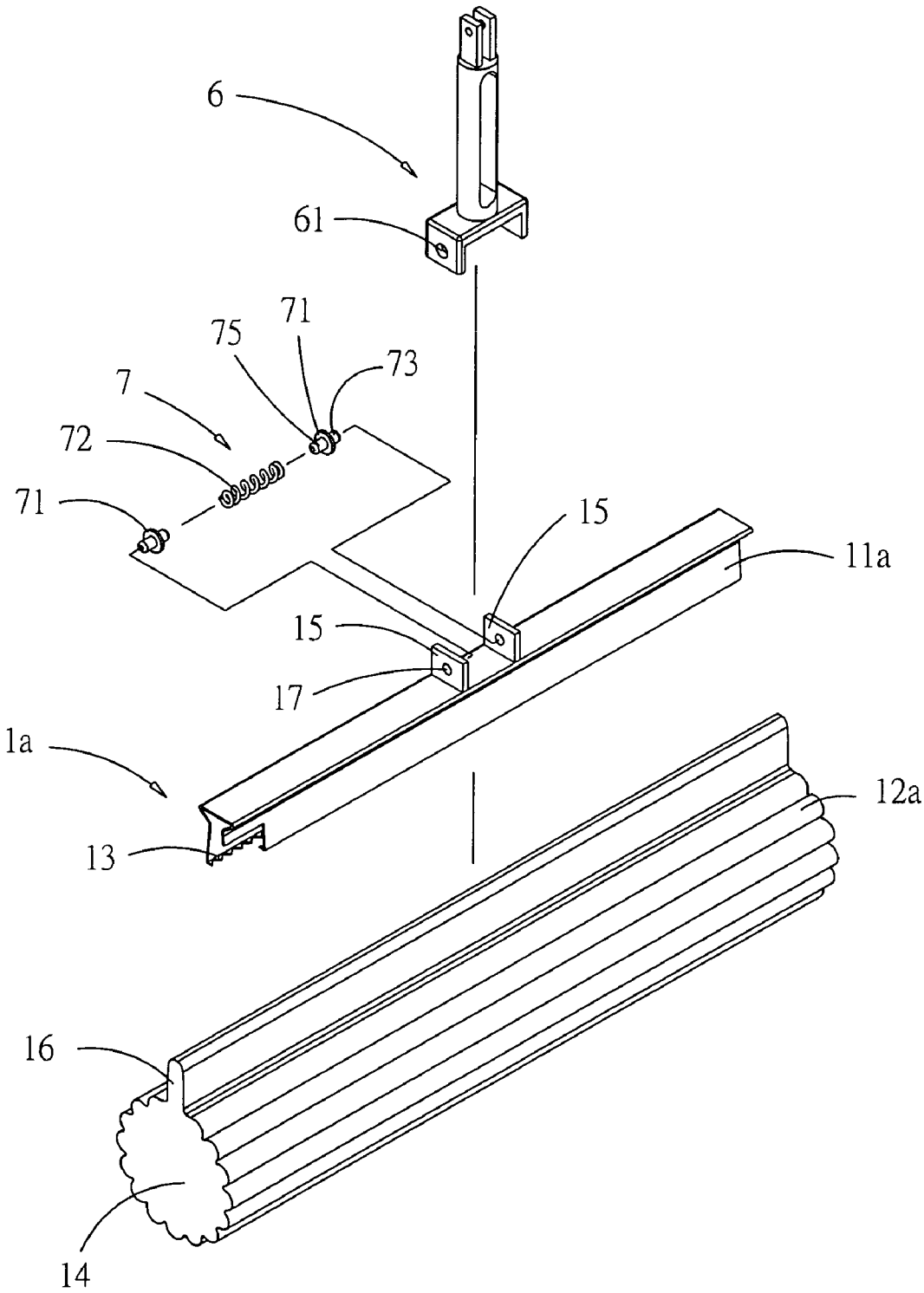
FIG. 4 is an exploded perspective view of the cleaning head of the present invention when dissassembled.
Figure 5:
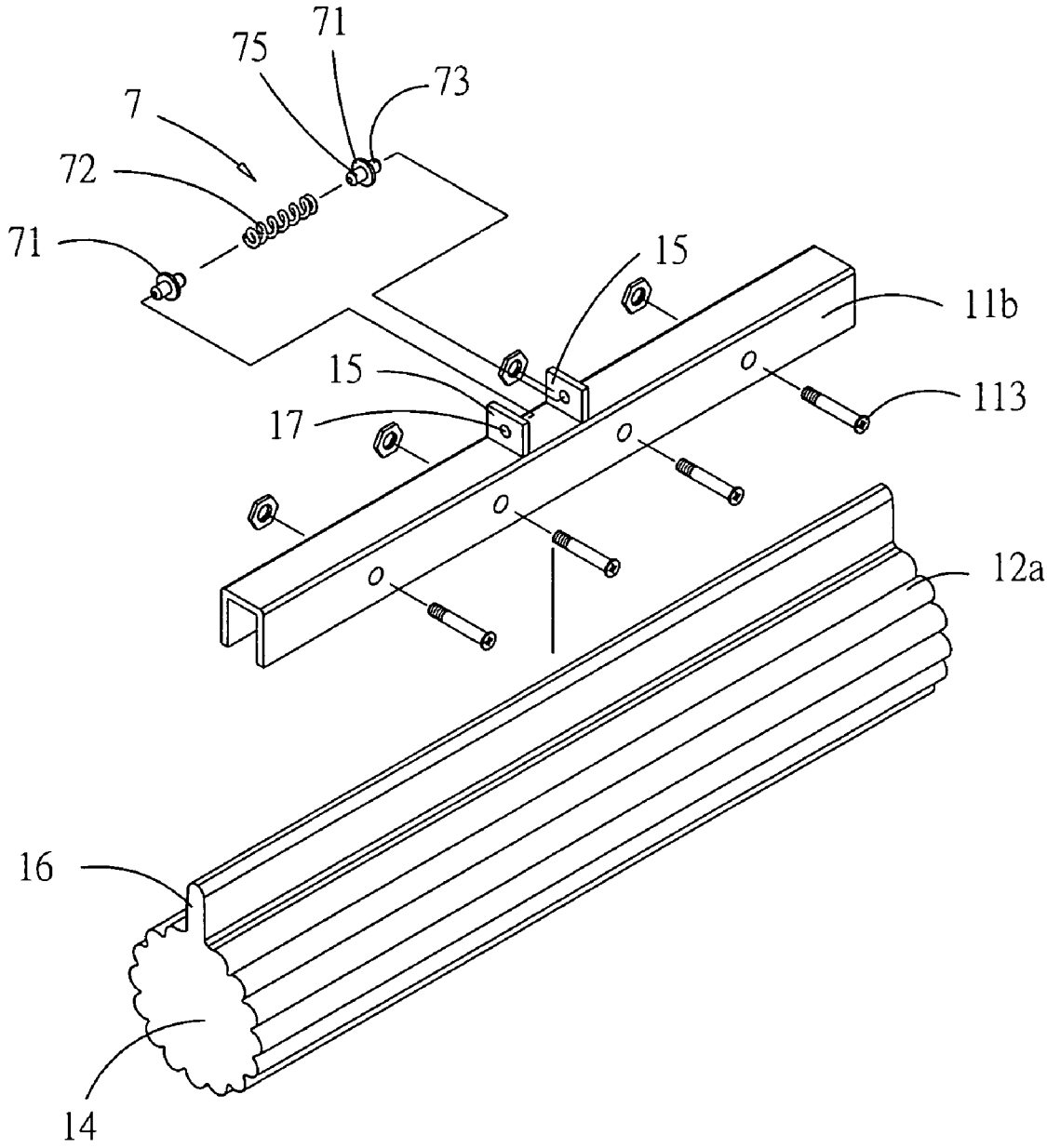
FIG. 5 is an exploded perspective view of the cleaning head of the present invention in the second embodiment.
Figure 6:
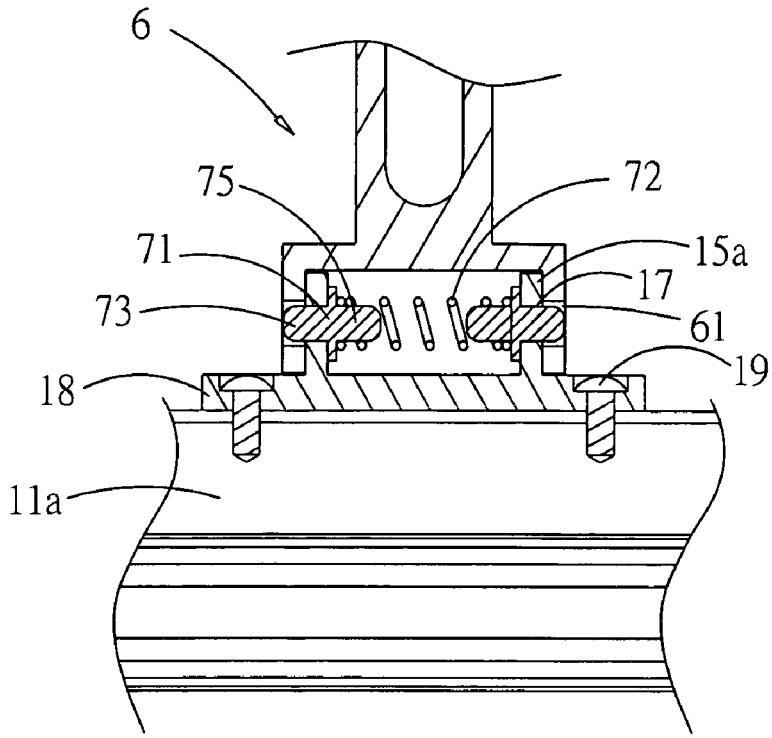
FIG. 6 is an enlarged sectional view of the cleaning head of the present invention in the third embodiment.
Figure 7:
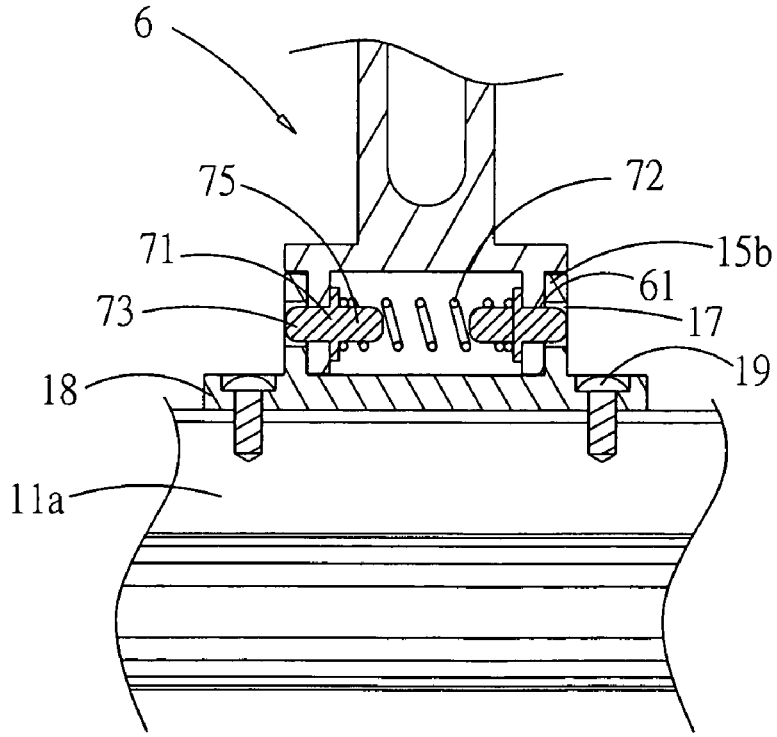
FIG. 7 is an enlarged sectional view of the cleaning head of the present invention in the fourth embodiment.
Figure 8:
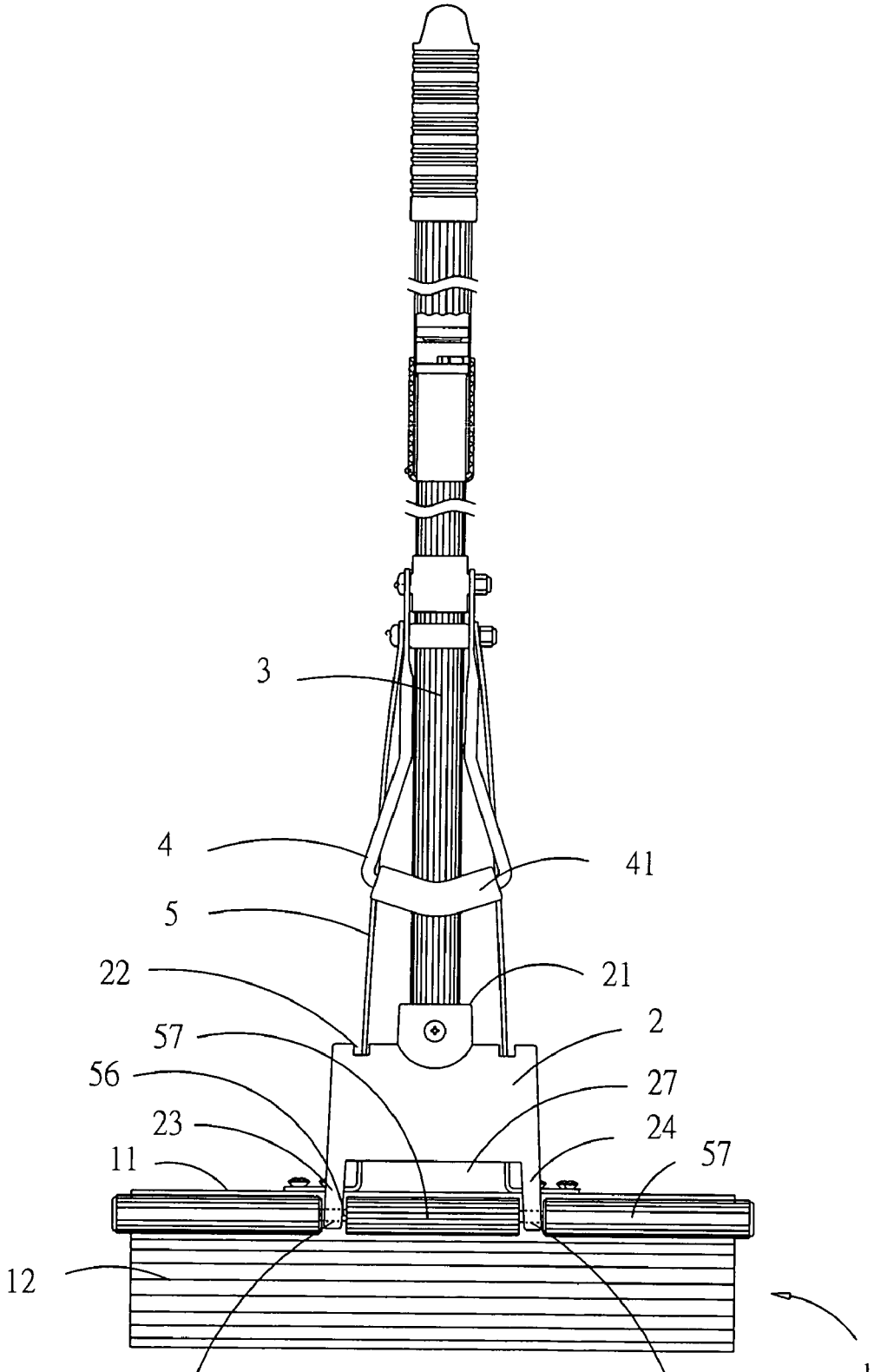
FIG 8 (PRIOR ART)
FIG. 8 (prior art) is a front view of a conventional sweeping and wringing apparatus.
Figure 9:
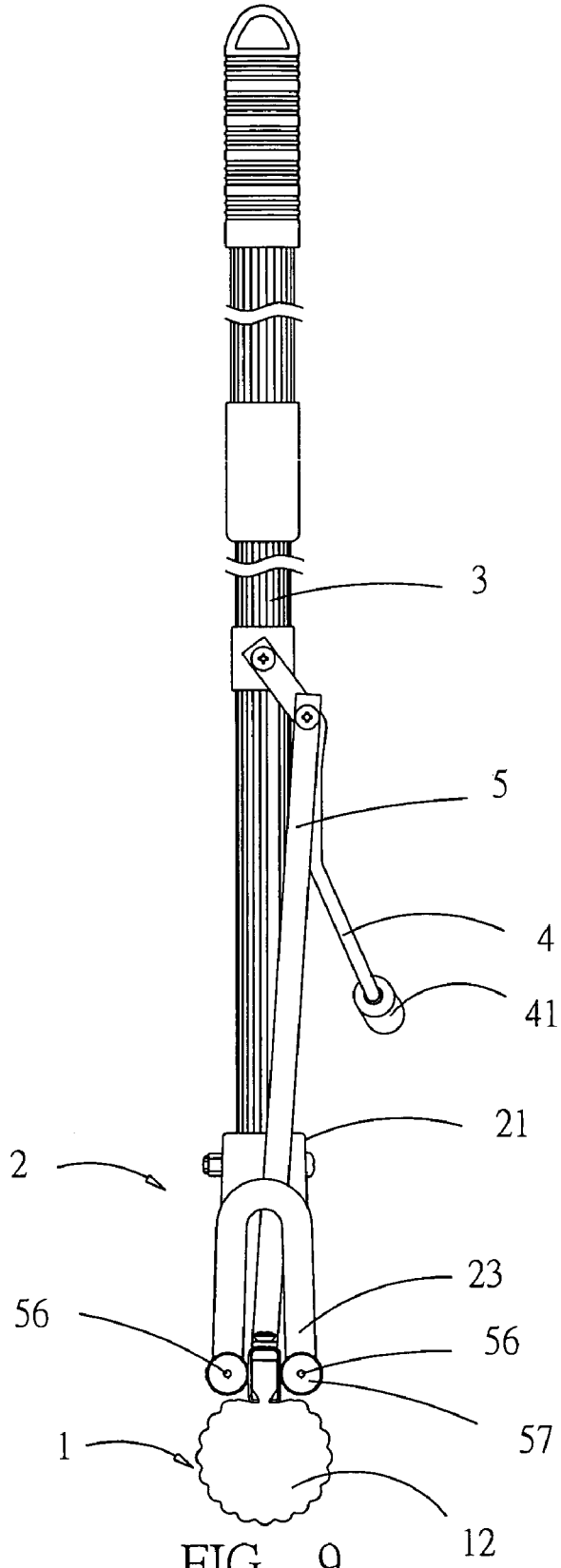
FIG 9 (PRIOR ART)
FIG. 9 (prior art) is a side view of a conventional sweeping and wringing apparatus.
Figure 10:
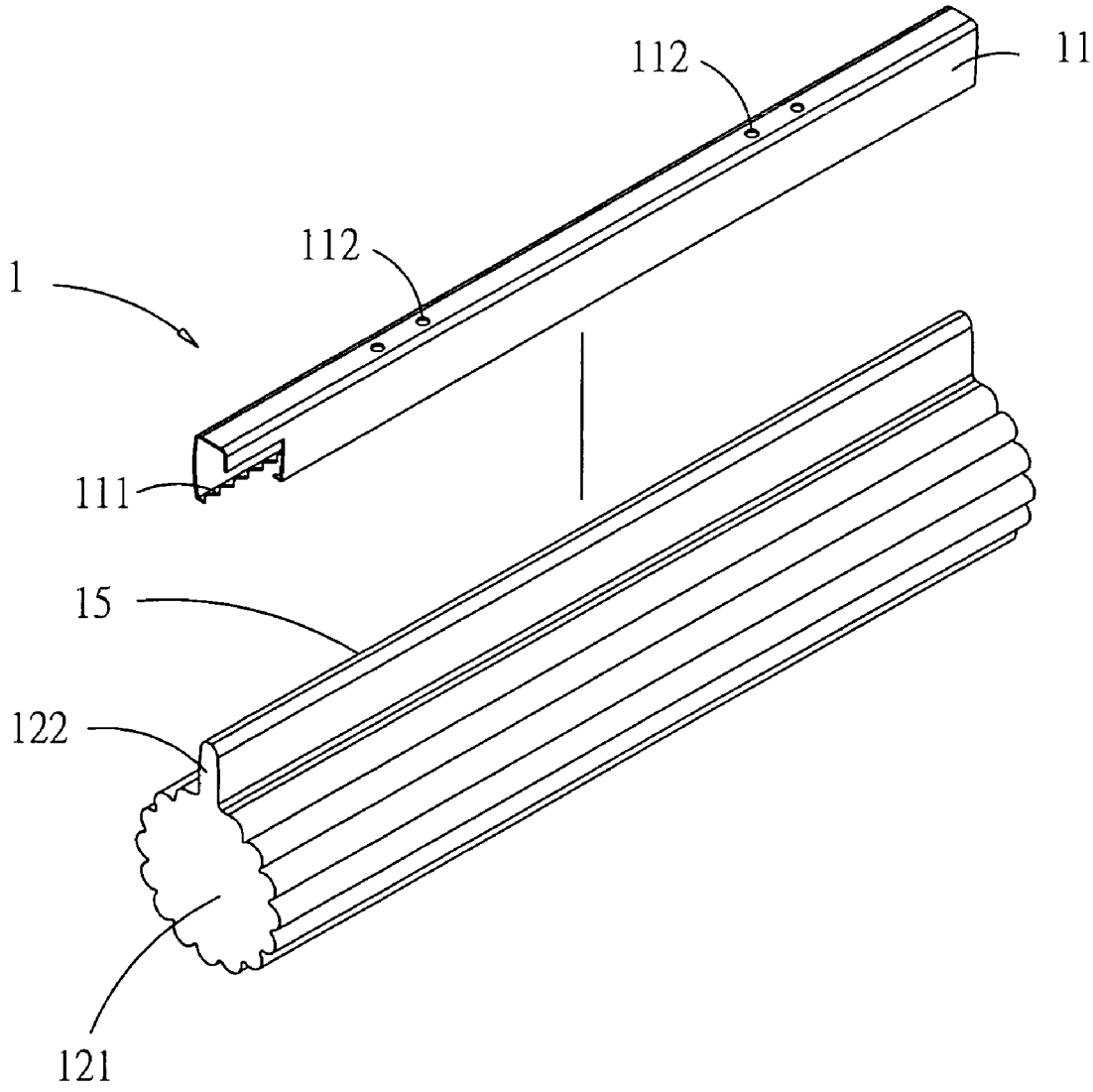
FIG 10 (PRIOR ART)
FIG. 10 (prior art) s a perspective view of a conventional cleaning head.

The invention claimed is:

1. A manually operated sweeping and wringing apparatus, comprising:

a cleaning head, further comprising a cleaning element, having a sweeping part and a held part attached to a top side thereof, a base plate formed of a metal channel elongated in an axial direction, attached on a lower open side to said held part, having on a top side two fastening elements projecting upwards, each having a through hole in the axial direction;

a main handle, being generally cylindrical with an elongated opening in a lower section of a sidewall, having an upper end, for holding during sweeping, a lower end adapted to receive a connecting part for mounting a cleaning head, and a squeezing head having a substantially u-shaped channel, with a closed side thereof mounted on said lower end, and an open side thereof having right and left arms, each said arm supporting a squeezer rod holding a plurality of squeezers adjacent to said cleaning element;

a wringing mechanism having a wringing handle adapted for attachment to a middle section of said main handle, a connecting rod with a first end connected to an upper section of said wringing handle and a second end disposed inside of said main handle, said connecting rod extending through said elongated opening in said side wall of said main handle, a connecting part, having a body adapted for sliding movement in said lower end of said main handle and an elongated cross hole in a middle section of said body, with an upper end connected to said second end of said connecting rod, and a lower end adapted for mating to said through holes of said fastening elements of said base plate;

a fixing device for attaching said fastening elements of said base plate onto said lower end of said connecting part, further comprising two end pieces, each having a central retainer, an outer projection with a circular cross-section, disposed against one of said fixing elements, passing through said hole thereof, and an inner projection, and a spring, placed between said two end pieces and having ends that are adapted to fit over said inner projections of said two end pieces;

wherein said fixing device holds said cleaning head onto said wringing mechanism in a secure and conveniently dismountable manner; and wherein a lower portion of said wringing mechanism is housed inside of said main handle.

2. The sweeping and wringing apparatus according to claim 1, wherein said base plate is made of metal channel with the open side downward-having jagged edges.

3. The sweeping and wringing apparatus according to claim 1, wherein said base plate is made of metal channel with the open side downward with said held part of said cleaning element being fastened thereto by bolts.

4. The sweeping and wringing apparatus according to claim 1, wherein said two fastening elements are attached to a connecting plate, which in turn is fastened to said base plate by screws.

5. The sweeping and wringing apparatus according to claim 4, wherein said connecting plate and said base plate form an integrated body.

6. The sweeping and wringing apparatus according to claim 1, wherein said fastening device is placed between said two fastening elements, with arms of said lower end of said connecting part placed outside thereof.

7. The sweeping and wringing apparatus according to claim 1, wherein said fastening device is placed between arms of said lower end of said connecting part, with said two fastening elements placed outside thereof.

* * * * *